US005390375A

United States Patent [19]

Fernstrum, Jr.

[11] Patent Number: 5,390,375

[45] Date of Patent: Feb. 21, 1995

[54] ADJUSTABLE TOILET TANK VALVE TO REGULATE FLUSH WATER VOLUME

[76] Inventor: John A. Fernstrum, Jr., 5950 N. 78th St. #152, Scottsdale, Ariz. 85250

[21] Appl. No.: 134,670

[22] Filed: Oct. 12, 1993

[51] Int. Cl.[6] ..... E03D 1/35

[52] U.S. Cl. ..... 4/404; 4/393; 4/415

[58] Field of Search ..... 4/392, 393, 403, 404, 4/415

[56] References Cited

U.S. PATENT DOCUMENTS

| | | | |
|---|---|---|---|
| 1,688,877 | 10/1928 | Palmer | 4/404 |
| 2,607,924 | 8/1952 | Kurkjian | 4/404 |
| 4,189,795 | 2/1980 | Conti et al. | 4/403 X |
| 4,419,773 | 12/1983 | Sullivan | 4/392 |
| 4,497,076 | 2/1985 | Sullivan | 4/393 X |
| 5,230,103 | 7/1993 | Antunez | 4/393 X |

*Primary Examiner*—Charles E. Phillips

*Attorney, Agent, or Firm*—Gregory J. Nelson

[57] ABSTRACT

A flapper valve for sealing the discharge outlet in a water tank and for regulating the quantity of water discharged during each flush by reducing the buoyancy of the flapper valve through water inflow into the flapper during flushing. The pivotally mounted flapper has an upper body section including an integral soft annular sealing flange and a downwardly depending body member. A cap is insertable at the lower ends of the side wall and defines a water inflow aperture therein. The cap is of a relatively rigid material and serves to support the buoyancy chamber formed by the upper body portion and the end cap against deformation under operating conditions. The cap may be provided with a valve disk for selective registry with one of multiple apertures to regulate the water inflow into the cone as a function of the dimension of the aperture selected in registry with the opening.

5 Claims, 2 Drawing Sheets

ADJUSTABLE TOILET TANK VALVE TO REGULATE FLUSH WATER VOLUME

BACKGROUND OF THE INVENTION

I. Field Of The Invention

The present invention relates to closure valves for toilet tanks and more particularly relates to a buoyancy rate adjustable flapper valve which reduces the volume of flushing water required.

II. Description Of The Prior Art

Conventional toilets include a water tank and a bowl. The toilet tank includes a ball valve which is raised from the tank discharge outlet to allow water to be discharged from the tank into the bowl. As the water level in the tank drops, the ball valve will drop into sealing engagement with the water discharge outlet. The water fill valve is usually actuated when the ball valve is lifted to introduce water into the tank. When the valve re-seals the discharge outlet, fill water will continue to flow into the tank until it rises to a predetermined level at which time it shuts off.

The prior art is replete with various structures and configurations of ball valves or other types of tank discharge valves. Many of these valves are designed to provide a flush of reduced water volume in order to conserve water. One type of water saving valve known as a flapper type valve is designed to allow water to flow to the interior of the flapper to increase its weight. By increasing the weight of the valve at a rate more rapidly than the reduction in the water level in the toilet tank, early closure of the valve can be effected prior to complete discharge of the water from the toilet tank or reservoir. By controlling the rate of valve weight increase, the tank water level at which the valve will seal the discharge outlet can be predetermined.

Some prior art patents suggest controlling the weight increase of the flapper valve by regulating the air bleed rate. This approach is usually only minimally effective since the air bleed must be of relatively small size and may become partially clogged due to the presence of minerals and debris in the water. It has been found that control of the closure rate by regulating the flow of the water inflow rate is generally more effective since water is incompressible and more easily controlled.

The following patents are representative and show adjustable tank discharge valves. For example, U.S. Pat. No. 4,419,773 discloses a discharge valve closure of the type which has a bleeder port to permit the conservation of water by causing the closer to shut the discharge valve prior to draining all the water from the tank. The discharge valve closure features an adjustment which permits at least a portion of the buoyancy chamber to be pivoted about the axis of the closure to position the bleeder port at a selected angular spacing from its top dead center. This adjustment allows the tank water level at which the closure shuts off the discharge valve to be adjusted.

U.S. Pat. No. 4,935,598 discloses a toilet tank flapper valve providing user selection of either a full or partial dispensing of the contents of the tank. A ball check valve located in the flapper either obstructs water from entering or permits it to enter the buoyancy chamber of the flapper valve. When water is permitted to enter a partial dispensing action results.

U.S. Pat. No. 4,189,795 commonly assigned with the present application discloses an improved ball valve for a toilet tank flush tanks for regulating the quantity of water released from the tank in the flush and includes a gauged or adjustable water inlet hole at the bottom of file ball valve and an air bleed hole at the top of the ball valve. The water inlet hole at the bottom of the ball valve is adjustable in size for selectively setting the flow of water entering the ball valve during a flush action and thereby determining the time the ball valve remains open to allow flush water to drain from the tank.

Other patents show toilet tank valves which permit inflow of water to achieve negative buoyancy at a predetermined point prior to complete discharge of the water from within the toilet tank can be found in the following patents: U.S. Pat. Nos. 2,511,545; 2,598,967; 2,741,775; 2,752,608; 2,830,302; 2,852,783; 2,869,141; 2,962,727; 3,086,218; 3,320,622; 3,5:46,715; 3,590,395.

III. Summary Of The Invention

The present invention provides a toilet flapper valve (sometimes referred to as a "flapper") which not only reduces the amount of water required for flushing but also provides a valve structure which has a flexible elastomeric flapper seal ring for providing an effective seal at the water discharge outlet. The valve also has a water inlet orifice communicating with a buoyancy chamber which may be adjustable which is part of a cone cap formed of a rigid or semi-rigid material which provides structural reinforcement to at least a portion of the flapper valve to support the flexible walls of the buoyancy chamber against excessive flexing or collapsing during operation.

The flapper valve for selectively sealing the discharge outlet of a toilet tank includes an annular elastomeric flange or ring which sealingly engages the discharge outlet. A cone depends from the flange and defines a buoyancy chamber. The upper portion of the cone adjacent the flange comprises a wall formed from an elastomeric flexible material as an integral part with the flange. A rigid or semi-rigid cone end cap comprises the bottom portion of the cone is supportingly engaged in the upper portion of the cone to provide support against undue flexing or collapse of the cone. In one embodiment, the end of the cone cap is apertured to control or gauge the water inflow into the buoyancy chamber defined by the cone.

A pair of arms extend from the flapper valve body to engage posts located on the discharge pipe in the water tank to permit pivotal movement of the flapper valve out of and into engagement with the discharge outlet.

A plurality of cone caps would be available with orifices or apertures of different size and the user can select the cone cap that provides the desired water inflow rate to determine the point at which the flapper becomes non-buoyant and rotates or pivots to a closed position.

In an alternate embodiment, the end cap is provided with a plurality of different size water inlet holes. An adjustable end cap having a single hole is rotatable relative to the cone cap and can be rotated to selectively register the hole therein with any one of the selected several water inlet holes in the bottom of the cap. In another embodiment, the aperture in the cap may be circular or may be various configurations such as arcuate. The opening or aperture in the adjustable end cap is selectively rotatable to expose a predetermined cross-sectional area of the orifice to control the water inflow rate.

Accordingly, it is a primary object of the present invention to provide a tank toilet flapper valve which permits the user to regulate the quantity of water discharged during a flush.

Another of the present invention is to provide an apparatus for regulating the rate of weight increase of the tank toilet flapper valve to control or regulate the amount of flush water discharged.

Yet another object of the present invention is to provide a toilet tank flapper valve having a construction with an elastomeric upper cone portion and a rigid cone cap which structure resists collapse or flexing during water fill and engagement with the discharge outlet.

A further object of the present invention is to provide a flapper valve for selectively limiting the water discharge from the toilet tank to conserve water.

Accordingly, it is another object of the present invention to provide a novel and improved flushing mechanism that is simple, easy to install in both new toilets and which may be easily retrofit in existing toilets.

It is another object of the present invention to provide a flush tank flapper valve having a cone which includes a rigid component and which flapper can be adjusted to close when a predetermined optimum amount of water has been discharged from the flushed tank.

IV. Brief Description Of The Drawing

The above and other objects, advantages and capabilities of the present invention will become more readily apparent from the following detailed description and claims taken in conjunction with the accompanying drawings in which:

Figure 1:
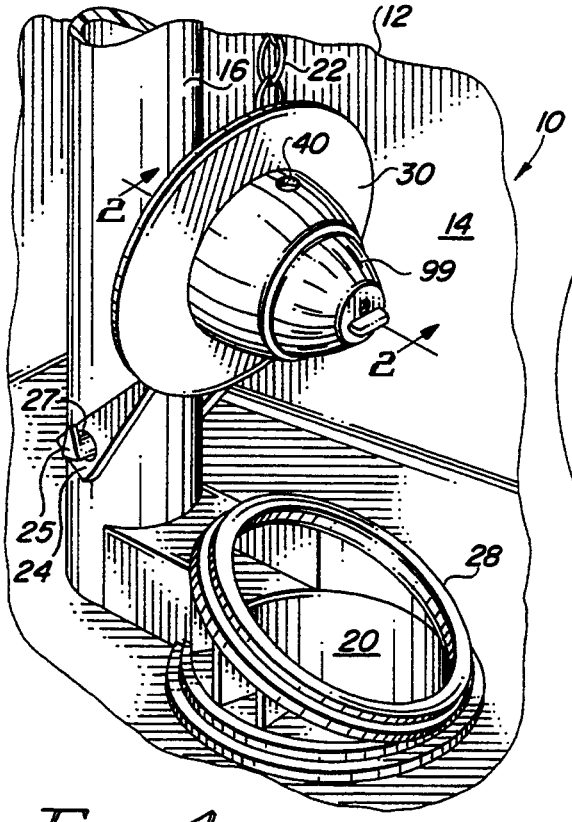
FIG. 1 is a partial view of part of a toilet flush tank equipped with the improved flapper valve of the present invention.
Figure 3:
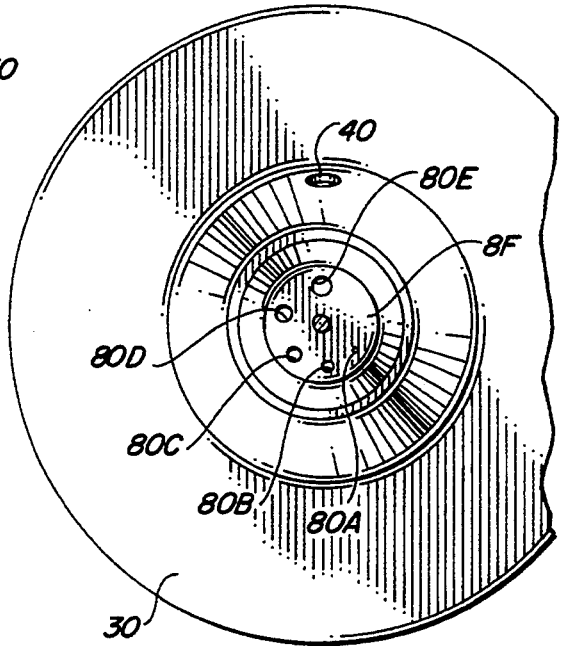
FIG. 3 is a sectional view of the flapper valve taken along line 3—3 of FIG. 2.

V. Detailed Description Of The Preferred Embodiment

FIGS. 1 to 4 show a preferred embodiment of the present invention generally designated by the numeral 10 which is intended for installation in a toilet flush tank. For purposes of background and understanding the invention, a portion of a representative and well-known toilet flush tank apparatus is shown which includes a tank 12 defining a reservoir 14 for containment of water. A conventional system includes a water inlet tube, not shown, which has a water valve mounted on the top of the tube and controls the water introduced into the flush tank. The valve is often controlled by a float such that when the water reaches a predetermined level, the valve will close. A conventional toilet also has a overflow pipe 16 which communicates with the toilet bowl by means of discharge pipe 20.

To initiate flushing, the handle disposed on the exterior tank is rotated which causes pivotal movement of the lever located at the top interior of the tank. The lever is connected by means of a lift chain or strap 22 to the flapper valve 10.

The novel flapper 10 is mounted in the tank and is pivotally supported by oppositely extending arms 24 and 26 connected to projections 25 oppositely extending from lower portion of the overflow tube. Apertures 27 are provided in the distal ends of the arms for this purpose.

After the flushing operation, the discharge pipe will have been evacuated of water and the flapper valve will engage and seal the discharge outlet as a result of the pressure or head of the water within the tank. The discharge outlet is located at the upper end of the drain pipe 20 and is shown having a generally circular inclined valve seat 28.

Upon initiation of the flushing operation, raising of the flush lever to cause the flapper valve 10 to pivot upwardly about the pivot axis defined by projections 25 will allow water to begin to flow past valve seat 28 into the drain pipe 20. As soon as water begins to flow through the discharge outlet, the flapper valve will begin to rise due to buoyancy. As the water level within the tank lowers, the flapper valve will lower when the water level reaches the flapper. When the water level approaches the level of the discharge outlet, the weight of the flapper will cause it to assume a position seated against the valve seat 28. Thereafter, the tank will begin to refill since the float controlling the fill valve will have dropped to a position causing the fill valve to open. During the water filling operation, the water weight or head pressure on the flapper valve will prevent it from pivoting upwardly due to its buoyancy.

Depending upon the nature and type of waste in the toilet bowl, less than all of the water in a typical tank is needed to complete a normal flushing operation. It then follows that any water flushed in excess of that required to dispose of the material in the toilet bowl is an unnecessary use of water. To conserve water, the flapper valve should close the discharge outlet as soon as sufficient water has been discharged to perform the flushing operation. Normally, in most toilets, this amount is approximately between 1.5 to 3.5 gallons. Older toilets often have a five gallon tank reservoir so that with water conserving toilets between 1.5 to 3.5 gallons of water may be conserved each flush which results in significant savings when one takes into account the number of toilets that are flushed daily.

The valve of the present invention does not reduce the amount of water in the tank which is termed the "water column" or "head". Rather, the present invention relies on the design of the toilet to achieve the head pressure and scouring action necessary for adequate flushing. The water level of the tank should be adjusted to the highest possible level to maximize available head pressure. The present invention conserves water by eliminating unnecessary residual flow of water from the toilet tank. With the valve of the present invention, when the handle or lever is actuated, the flapper cavity or buoyancy chamber is filled with air which causes the flapper valve to remain in the open position. As the flapper valve rotates to the vertical position, water enters the pre-set gauged hole through the end cap in the bottom of the cone and causes air to exit through the bleed hole. The size of the bottom inlet hole determines the point at which the flapper achieves negative buoyancy and begins to rotate closed. The weight of the trapped water firmly seals the flapper against the valve seat. Water within the cone is thereafter discharged into the bowl.

A significant advantage of the invention is that it utilizes maximum head pressure and does not impede the scouring action. Further, the construction of the valve having a rigid or semi-rigid cone portion resists flexing or collapsing of the valve which would seriously impede the proper operation of the valve.

Referring to FIGS. 1–5, the flapper valve 10 permits adjustment of the buoyancy of the flapper to limit water discharged through the discharge pipe to an amount less than that which would have otherwise been discharged. The flapper as indicated above is supported on a pair of arms 24 and 26 which extend oppositely from an annular sealing ring 30. A dome 32 is concentrically located with respect to integrally attached annular flapper sealing ring 30. A projection 34 extends from the dome and defines an aperture 36 for attachably engaging a section of the lift chain 22.

The upper body portion of the flapper valve further includes a downwardly extending side wall 38 which depends below the lower surface of the annular ring. The entire upper body section including the annular ring, dome and depending wall are preferably fabricated from a relatively soft, elastomeric material such as a natural or synthetic rubber. This construction allows the upper body portion to be integrally fabricated as a unit by injection molding techniques and further provides a construction which permits an effective seal to be formed between the annular sealing ring and the discharge seat.

While the flexible elastomeric material is desirable from the standpoint of fabrication and sealing, it also involves certain disadvantages. The elastomeric material is inherently flexible and is not on a desirable characteristic that the lower cone portion of the valve be unduly flexible. Flexing or collapsing of the cone will impair the operation of the valve. The flexing or collapsing is a result of the pressure differential that may exist between the exterior of the cone and the internal buoyancy chamber. Flexing or collapsing will cause the air from the buoyancy chamber to be quickly expelled resulting in the valve closing prematurely prior to complete flushing. The term "cone" as used herein is used broadly to include geometric configurations having either a curved or linear side wall as viewed in cross-section and refers to the bulb-like portion of the flapper construction depending beneath the underside of the annular seal ring. The cone 100 includes the upper side wall 38 and the rigid cone cap at the lower end. A substantial portion of the buoyancy chamber is defined by the cone.

An air vent 40 extends through the side wall 38 of the cone proximate the underside of the annular flange or ring at a location opposite the arms 24. The upper side wall 38 of the cone is formed from an elastomeric material and terminates at lower peripheral edge 42. The lower portion of the cone 100 comprises a cone cap 50 which is rigid or semi-rigid which gives support to the entire cone. The cone cap is fabricated from a plastic material such as ABS or acetyl resin (such as that sold under the trademark "Delrin") having sufficient rigidity so as not to appreciably flex or deform during operation so as not to effect the buoyancy of the flapper. The rigidity of the cone 100 should be sufficient to appreciably resist flex or collapse in the operating conditions which impose approximately from 1" to 12" of water head pressure on the cone. The rigidity will maintain substantial constant buoyancy which will ensure repetitive long-term accuracy and repeatability of control of the water volume discharge. Specific gravity of the flapper should exceed 1.0.

Figure 2:
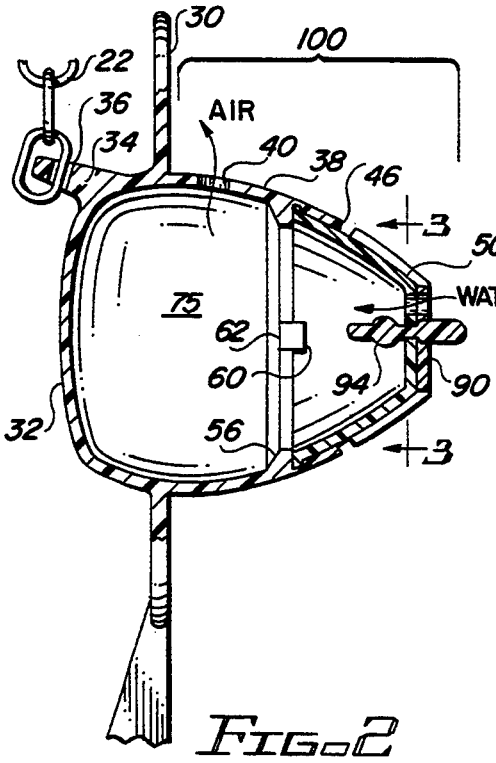
FIG. 2 is a sectional view taken along line 2—2 of FIG. 1.
Figure 4:
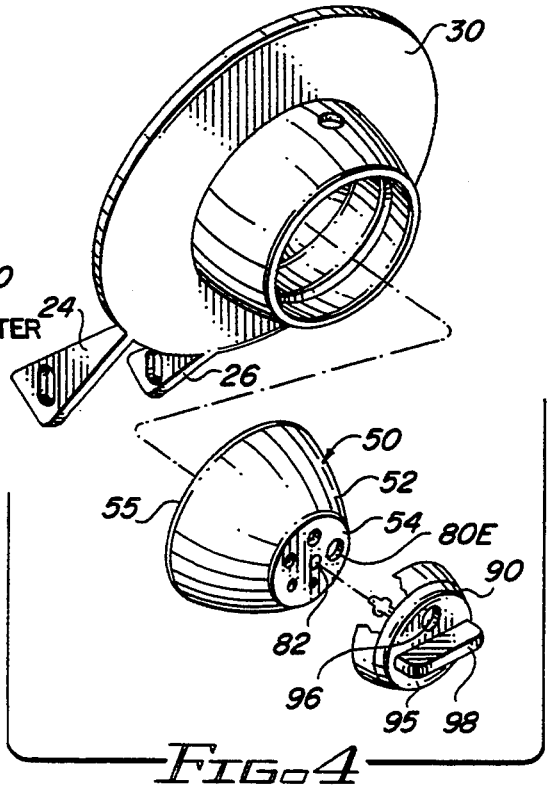
FIG. 4 is an exploded perspective view of the flapper valve of FIG. 1.

The cone cap 50 has a continuous side wall 52 which may be slightly curved or linear terminating at a flattened end wall 54. The diameter at the upper edge 55 of the cone cap is selected in relation to the diameter of the lower edge 42 of the depending side wall to permit the cap to be partially inserted into the side wall as best shown in FIG. 2. The flexible, elastomeric material of side wall 38 facilitates assembly. An annular flange 56 extends about the interior of side wall 38 to provide a stop limiting the insertion and to prevent the cap from being pushed out of position during operation. The upper edge of the cone cap 50 defines a recess 60 which in the assembly operation is aligned with projection 62 to assist in proper assembly.

The flattened end wall of the cone cap is provided with a plurality of apertures of which five are shown. Each of these apertures is differently sized from the smallest 80A to the largest 80E. When the valve is properly assembled, aperture 80E aligns with air vent 40 at the uppermost position as seen in FIG. 1.

A concentric bore 82 is provided in the cone cap. An adjustable end cap 90 is rotatably secured to the bottom face of the cone cap by means of engagement of axle 94 in concentric bore 82. The adjustable end cap has an end wall 95 and is provided with an aperture 96 which is the size of the largest aperture 80E in the cap. The adjustable end cap is made of a suitable material such as a synthetic flexible material such as vinyl or may be a rubber material. Preferably, the material of the end cap is selected to provide a seal to prevent water flowing into the buoyancy chamber except through the selected orifice.

Various settings can be visually indicated by indicia such as indicia 99 located about the periphery of the cap. Indexing tab member 98 on the end cap will assist in rotating the cap and along with the cooperating indicia 100 will provide the user an indication of the flow rate setting such as flow rate settings from 1 to 5, that is from the lowest rate to the highest rate. Upon rotation of the disk with respect to the cap, a selected aperture 80A to 80E and appropriate valve setting can be achieved or the user may select the flow blocking position 80F. The latter position affords the greatest buoyancy and slowest closure rate.

In operation, flapper valve is actuated by lifting the valve out of seating engagement with the discharge outlet. Thereafter, water will flow from within the tank reservoir 14 through the valve seat 28 into the discharge pipe 20.

Prior to raising the flapper valve, the buoyancy chamber 75 defined within the cone and dome is filled with air since all water would have drained through the lower end of the cone into the discharge pipe. The air vent 40 is also located in the drain pipe and isolated from water in the tank. When the flapper valve is raised, the air within the cone can escape through the vent 40. Simultaneously, inflow of water occurs through the selected aperture 80A to 80E in the end wall 95 due to the head pressure in the tank. As the chamber 75 fills with water, the buoyancy of the flapper valve will be reduced. When the buoyancy becomes zero and the weight of the flapper valve begins to exceed that of the equivalent volume of water, the flapper valve will sink or rotate towards the closed position. Closing of the valve should occur before the entire volume of water within the tank has been emptied but after siphonic action to evacuate the bowl has occurred.

The rapidity with which the flapper valve will sink is a function of the rate of water flow into the buoyancy chamber. The rate of water flow is primarily controlled by the selected size of the passageway aperture through which water enters. Air vent 40 can be relatively small without affecting the water inflow but is preferred as relatively large to minimize the likelihood of clogging. By inspection it will become apparent that the faster the flapper valve begins to sink, the less water will have been discharged from within the tank and less water will have been available in the flushing operation. Thus, control is achieved by regulating the buoyancy of the valve by selecting the appropriate setting of the adjustable end cap rather than by controlling the air bleed rate. By controlling the water inflow, proper timing and closing of the flushing cycle can be accomplished and by simple trial and error the user can select the setting that best achieves complete flushing and bowl re-seal while achieving reduced water consumption.

The overall construction of the flapper valve 10 facilitates manufacture as both the relatively flexible elastomeric components and the rigid or semi-rigid components as well as the adjustable end cap may be molded by conventional techniques. The assembly is a simple snap fit or slip-together assembly. The overlapping insertion of the rigid or semi-rigid cone cap supports the upper cone side wall against undue flexing as the cap supportingly engages a substantial portion of the side wall 38. Heretofore, it was necessary that the entire cone be made rigid to achieve such benefits which construction added considerably to the cost and complexity of both the manufacture and assembly operation.

FIGS. 5 to 8 show another embodiment of the present invention generally designated by the numeral 200 which again has an annular seal ring or flange 230 with depending or extending arms 224 and 226 for pivotally mounting the valve in the toilet tank. A dome 232 concentrically projects from the upper side of the annular flange. Side wall 238 which is slightly inwardly curved or convex depends from the underside of the annular sealing ring and terminates at lower edge 235. Projection 234 defines an aperture 236 for attachment of lift chain 222. The arms, dome, sealing ring and upper wall portion are all preferably integrally formed of a flexible elastomeric material by a molding process.

Figure 5:
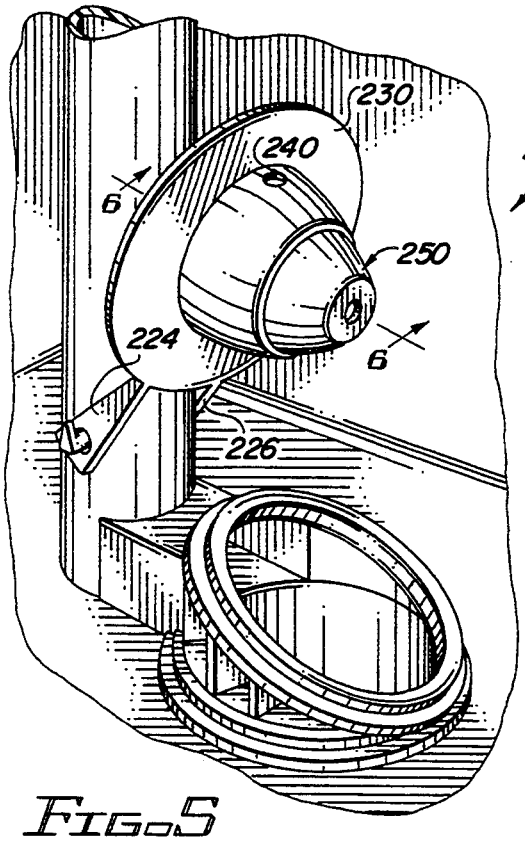
FIG. 5 is a perspective view of an alternate embodiment of the flapper valve of the present invention.
Figure 7:
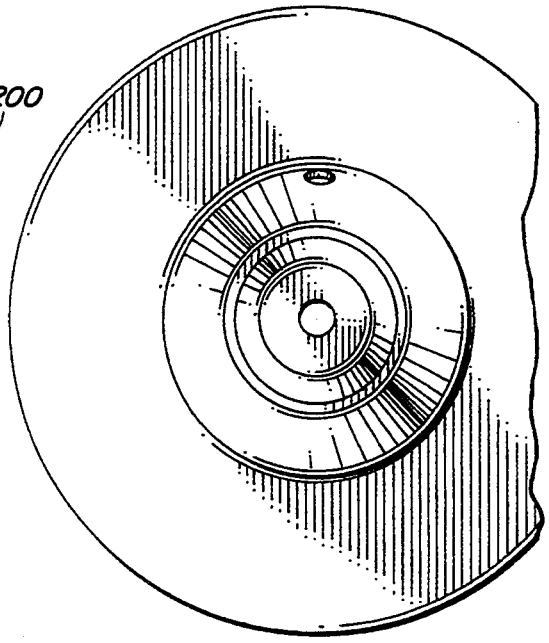
FIG. 7 is a bottom end view of the alternate embodiment of the flapper valve as shown in FIG. 5.

The lower end of the cone is comprised of a rigid or semi-rigid cone cap 250 which has generally inwardly converging side wall 252. The cone cap is truncated having a planar end wall 254. An air vent 240 is provided in the side wall at a location immediately below the bottom side of the annular flange and oppositely displaced from the arm so that the vent is generally upwardly disposed when the valve is pivoted to an open position as seen in FIG. 5.

The cone cap 250 is insertable along the lower edge of the depending side wall to complete the cone structure defining an interior buoyancy chamber 275 with the dome and upper side wall portions. A stop or projection 256 may be formed on the interior of side wall 238 to facilitate assembly and also to prevent the cone cap 250 from being displaced inwardly toward the interior of the cone during operation.

The end wall of cone cap 250 defines an orifice 280 of predetermined size. A cone cap 250A, similar in construction to cap 250, is provided with an orifice 280A having a different size than orifice 250A. In other respects the cone caps 250 and 250A are the same. A plurality of cone caps with different orifice sizes will be made available to the user depending upon the flow control requirements which may vary with the toilet type, manufacture, water capacity and the like. Other factors which are important to the proper function of the valve are: (1) specific gravity of the valve; (2) the volume of the chamber: (3) size of the water orifice. Proper sizing of the cap insert for different toilet units can be established empirically to determine when negative buoyancy will occur in the flushing operation. It is important to balance these three factors so closure occurs at the point when sufficient water is discharged to insure complete flushing. Further, the flapper should operate after siphonic action (the surge which siphons waste from the bowl) has occurred. Thus, the user may select a cone cap having an aperture orifice which provides the desired control.

Figure 6:
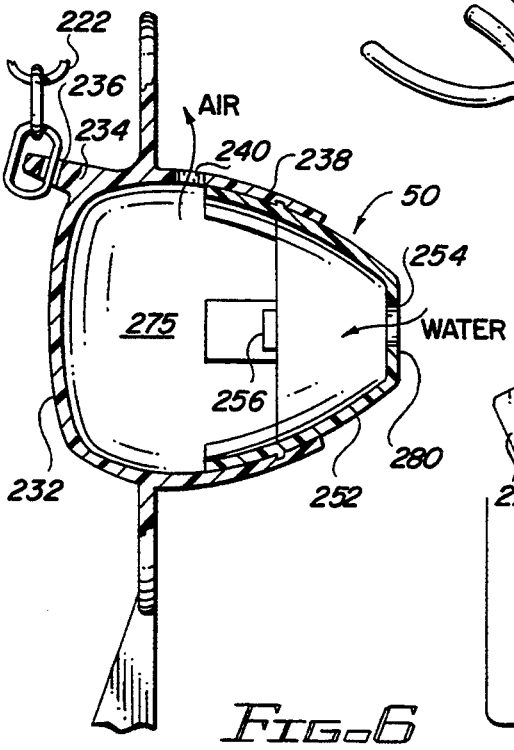
FIG. 6 is a sectional view taken along line 6—6 of FIG. 5.
Figure 8:
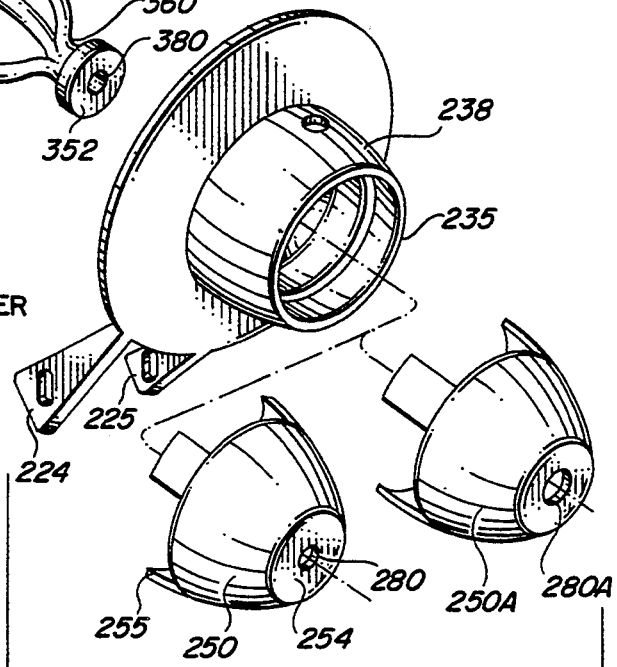
FIG. 8 is an exploded perspective view showing the flapper valve of FIG. 5 with caps having orifices of different sizes.

In order to further support the flexible cone, cone cap 250 is shown as provided with a plurality of upwardly extending projections 255 which are spaced apart around the periphery of the upper edge of the cap. The projections, once the cone cap is inserted into engagement with side wall 238, will extend upwardly along a substantial portion of the interior of the side wall to reinforce it as best seen in FIG. 6 to supportingly engage a substantial portion of the side wall 238. Preferably the cap comprises at least one-third of the length of the cone and the projections extend for approximately another one-third of the cone length.

Thus, the insertable, rigid or semi-rigid cone cap provides several important functions. It provides the user selectability as to the orifice size. By selecting the cap having an appropriate orifice size, the water inflow rate can be controlled. Further, the rigidity of the cone cap along with the rigidity of the upwardly extending arms will reinforce the cone construction to resist flexing and deformation during operation.

Figure 9:
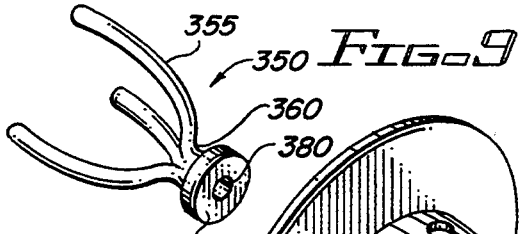
FIG. 9 is a perspective view showing still another alternate construction of the cone cap.

FIG. 9 shows a slightly modified rigid or semi-rigid cone cap 350 having a disk-like end face 352. The end face defines a water inlet orifice 380. Annular recess 360 extends above the end face. A plurality of semi-rigid arms 355 project upwardly. When assembled, the arms 355 supportingly extend along the interior of the flexible side wall of the cone. The lower end of the side wall extends to engage the annular recess 360. As has been explained, a plurality of cone caps having orifices of varying sizes may be provided to the user. When using the cone cap of this embodiment, it may be necessary to elongate the side walls of the upper cone section so the side wall extends to the recess 360.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. A flapper valve to be used with a toilet tank for selectively controlling the quantity and volume of water discharged from the tank at a discharge outlet into a discharge pipe during each flush by reducing the buoyancy of the flapper valve by permitting water inflow into the said flapper valve during the flushing operation, said flapper valve comprising in combination:

(a) an upper valve body portion fabricated of a relatively flexible, elastomeric material, said upper body including:

(i) an annular flange for engaging the discharge outlet and for sealing the discharge outlet against water flow into the discharge pipe from the toilet tank when the valve is in a first closed position:

(ii) a side wall integrally formed with and depending from said flange, said side wall having a lower peripheral edge;

(iii) mounting means for pivotally mounting said flapper valve to permit movement of said flapper valve from said first closed position to a second position raised above the discharge outlet and within the water toilet tank to permit water flow through the discharge outlet from the toilet tank when a flushing operation is commenced;

(iv) an air vent disposed in a predetermined location in the side wall for venting air from said valve body, said air vent being of sufficient size to prevent it from materially affecting the rate of water flowing into the said valve; and (v) said vent being located in said side wall at a generally diametrically opposed position from said mounting means for positioning said vent in the upper part of the valve upper body when said flapper valve is in the second position; and (b) a cone cap having sufficient rigidity so as not to appreciably deflect or flex during the flushing operation, said cone cap having a side wall with an upper peripheral edge and a lower end wall, said cone cap being in engagement with the upper valve body with the side wall of said cone cap extending downwardly from the lower peripheral edge of the upper valve body wherein said cone cap and said upper valve side wall form the wall of an interior buoyancy chamber;

(ii) whereby said cone cap provides sufficient support to the upper valve body side wall so the side wall will not appreciably deform under operating conditions in the toilet tank; and (iii) said cone cap lower end wall defining means for adjusting the size of at least one through passageway therein to regulate the water inflow rate into the buoyancy chamber as a function of the size of the passageway.

2. The flapper valve of claim 1 wherein said cone cap defines a plurality of different sized apertures to permit water flow therethrough into said chamber and an adjustable end cap rotatably secured to said cone cap having an opening therein for selective registry with one of said different size apertures to regulate the water inflow rate into the buoyancy chamber as a function of the size of the aperture registered with said opening.

3. The flapper valve of claim 1 wherein said cone cap further includes projection means extending from said upper edge and in an assembled position engaging the interior of said side walls to reinforce same.

4. The flapper valve of claim 1 wherein said annular flange includes a dome element having an interior which interior forms the upper end of the buoyancy chamber.

5. The flapper valve of claim 2 wherein said cone cap includes a flow blocking position.

* * * * *